US005895294A

United States Patent [19]

DeLangis et al.

[11] Patent Number: 5,895,294

[45] Date of Patent: Apr. 20, 1999

[54] PLUG MODULE FOR DSX TELECOMMUNICATIONS JACK MODULE

[75] Inventors: Eric DeLangis, Loveland; Gary Stanish, Superior, both of Colo.

[73] Assignee: Remote Switch Systems, Inc., Loveland, Colo.

[21] Appl. No.: 08/988,727

[22] Filed: Dec. 11, 1997

[51] Int. Cl.[6] ..... H01R 13/00

[52] U.S. Cl. ..... 439/669; 379/29; 379/328

[58] Field of Search ..... 439/669, 668, 439/660, 626, 709, 723, 623, 188; 379/442, 29, 328, 397; 361/733

[56] References Cited

U.S. PATENT DOCUMENTS

| | | | |
|---|---|---|---|
| 3,678,440 | 7/1972 | Gilsdorf | 439/592 |
| 3,822,415 | 7/1974 | Deitch | 439/55 |
| 3,829,814 | 8/1974 | Straus | 439/101 |
| 4,368,941 | 1/1983 | Martin | 439/540.1 |
| 4,588,251 | 5/1986 | Newton | 439/638 |
| 4,737,113 | 4/1988 | Hopper et al. | 439/78 |
| 4,815,104 | 3/1989 | Williams et al. | 375/36 |
| 4,861,281 | 8/1989 | Warner | 439/540 |
| 5,078,624 | 1/1992 | Burroughs et al. | 439/668 |
| 5,233,501 | 8/1993 | Allen et al. | 361/733 |
| 5,393,249 | 2/1995 | Morgenstern et al. | 439/668 |
| 5,432,847 | 7/1995 | Hill et al. | 379/328 |
| 5,439,395 | 8/1995 | Laukzemis | 439/668 |
| 5,669,779 | 9/1997 | Galloway et al. | 439/188 |
| 5,685,741 | 11/1997 | Dewey et al. | 439/668 |

*Primary Examiner*—Neil Abrams
*Assistant Examiner*—Miichael C. Zarroli
*Attorney, Agent, or Firm*—William E. Hein

[57] ABSTRACT

In accordance with the present invention, plugs are provided for insertion into the conventional "310" or bantam styles of DSX telecommunications jacks to permit monitoring of both transmit and receive circuit paths without injecting noise into those circuit paths and without any risk of interrupting or breaking those circuit paths. Because these two conventional jacks differ in size, two sizes of plugs are necessary. However, both sizes of plugs are identical in operation and function. The teachings of the present invention can also be applied to plugs for insertion into other types of conventional jacks, such as standard phone jacks. In these other applications, the plug of the present invention requires only one contact for monaural applications and two contacts for stereo applications.

7 Claims, 11 Drawing Sheets

PLUG MODULE FOR DSX TELECOMMUNICATIONS JACK MODULE

BACKGROUND AND SUMMARY OF THE INVENTION

This invention relates generally to plugs for telecommunications jacks and, more particularly, to an improved plug for DSX telecommunications jacks which permits monitoring of both transmit and receive circuit paths without injecting noise or breaking the electrical connections of these circuit paths. Throughout the telecommunicatioins industry, there are great numbers of test and monitor access jacks connected to networks. These jacks are used to provide access to circuits for testing, monitoring, and reconfiguring a telecommunications system by maintenance and service personnel.

There are currently several types of these jacks in use. However, the preponderance of installations consist of two main styles: the "310" jack and the "bantam" jack. These two styles differ only in the length and diameter of the jack and its associated mating plug. The electrical and mechanical properties of these two styles of jacks are otherwise the same. They have been in service in the telecommunications industry for many decades, resulting in hundreds of millions in service around the world today.

A typical jack module consists of three individual access jacks. The top jack is a monitor access point, which is used to monitor or listen to either the transmit or the receive side of a circuit, but not both, without disturbing the electrical signals present at the jack. The second jack, located just below the monitor jack, is usually wired as the transmit jack, to carry the data being transmitted to other equipment. Below the transmit jack is the receive jack, which carries the data coming from other equipment into the equipment in which the jack module is located. When the mating plug is inserted into either the transmit jack or the receive jack, the circuit path is broken, thereby interrupting the customer's traffic and introducing a service outage for the customer. On critical data circuits or circuits carrying many voice channels, this service interruption is unacceptable.

While inserting a mating plug into the monitor jack does not result in breaking the circuit path, the monitor jack can only be wired to a selected one of the transmit or receive circuit paths, thereby preventing monitoring of the other circuit path at this jack. In order to monitor the other circuit path, a second monitor jack must be provided at a different location at which the other circuit may be accessed.

In the past, the telephone company manually patched the transmission path using patch cables plugged into the transmit and receive paths of a circuit, while company personnel rewired the physical connections from the old equipment to the new equipment. When the rewiring was completed, the patch cables were pulled out of the jacks. However, each time the patch cables were plugged into or removed from one of the circuit paths, the customer's data was interrupted. This resulted in short dropouts, yellow alarms or even complete system failure for the customer, depending upon the skill of the company personnel performing the work. Because of the severe impact on customer data, telephone companies would typically schedule such work to be performed during maintenance windows between midnight and 2:00 A.M., and only following the time consuming step of obtaining a release from the customer. In addition, since telephone companies are regulated utilities, they are required to provide a minimum grade of service. Each time they perform work on a circuit that results in interruption of a customer's traffic, their overall grade of service is adversely affected. In summary, the manual patching of transmit and receive paths by telephone company personnel has generally been an unsatisfactory solution to the problem.

The need to access both transmit and receive circuit paths at a monitor access point has been more recently addressed by locating the far end of the circuit where the other circuit path originates. Sometimes, this is within the same central office, but oftentime is at a different central office or at the customer's location. More often than not, the other end of the circuit is located at some distance from the first end. This necessitates the use of mulitple pieces of test gear to monitor a single circuit since a single piece of equipment cannot physically reach the two remote ends of the circuit. Additional personnel, resulting in additional travel costs, are required at the far end of the circuit to monitor the other circuit path.

Typically, the transmit circuit path is wired to the monitor jack. In this way, each transmitter can be monitored, and the complete circuit can be analyzed. That is, transmit and receive paths for both ends of the circuit can be monitored since the transmit end of one circuit is connected to the receive end of the other and vice versa. This arrangement is known as a cross-connect, and the cross connections are made at the cross-connect shelves. The cross-connect shelves are used for circuit monitoring, testing, and rerouting.

The mating plug for this type of jack resembles a standard phono plug. It has a round circular tip that is electrically isolated from the ring portion of the plug, and both of these contacts are electrically isolated from the sleeve portion of the plug. The tip and ring contacts carry the actual data signals, while the sleeve is uaually left floating or is grounded. When the plug is inserted into the jack, the plug's tip and ring contacts make connection with the common side of the two internal contacts of the jack. When this occurs, the normally closed internal contacts are opened so that they no longer make connection to the common contacts within the jack, thus breaking the circuit. The plug and jack are designed so that the jack's contacts align with detents on the plug's tip and ring contacts, and the contact force applied by the jack hold the plug firmly in place. In the case of the monitor jack, the contacts are wired parallel with the circuit path that is to be monitored, so that inserting a plug into the monitor jack allows monitoring of the circuit without breaking or interrupting it. Internal 4000-ohm resistors are built into the jack's monitor port to prevent short circuiting the signals.

One known prior art solution to the problem discussed above has been to mill down a conventional circular mating plug of the type illustrated in FIG. 1A to be semi-circular in shape, as illustrated in FIG. 1B. When this modified plug is inserted into a jack with the flat milled surface facing the internal jack contacts, no contact is initially made with the internal jack contacts. In order to monitor the circuit to which the jack is connected, the modified plug is gently rotated until the tip and ring contacts thereof just touch the sides of the internal jack contacts. This solution is fraught with problems, not the least of which is unreliability. If the plug is not inserted into the jack correctly, the circuit will be broken. This undesirable result can occur even if the plug is only slightly misaligned. In addition, since the internal contacts of the transmit and receive jacks are rotated 180 degrees with respect to each other, it is very easy to insert the plug upside down, thereby breaking the circuit. As stated above, once the plug is inserted into the jack, it must be gently rotated to make connection with the internal jack contacts. However, if the plug is rotated too far, the circuit is again broken. Once rotated, the plug must be held in place since the retention mechanism in the jack that holds a conventional plug in place after insertion will not engage the modified plug. When the plug comes into contact with the internal jack contacts, it can cause them to move slightly horizontally, resulting in the introduction of noise into the circuit. Another problem with these modified plugs arises when the internal jack contacts are not in perfect vertical alignment. In this instance, the plug will only contact one of the two internal jack contacts. Rotating the plug more will cause that contact to open before the second contact is made.

In accordance with the present invention, plugs are provided for insertion into the conventional "310" or bantam styles of DSX telecommunications jacks to permit monitoring of both transmit and receive circuit paths without injecting noise into those circuit paths and without any risk of interrupting or breaking those circuit paths. Because these two styles of conventional jacks differ in size, two sizes of plugs are necessary. However, both sizes of plugs are identical in operation and function.

DETAILED DECRIPTION OF THE INVENTION

Figure 1A:
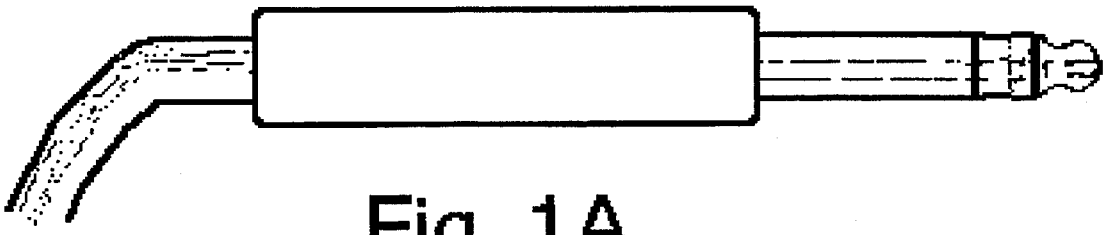
Fig. 1A Prior Art
FIG. 1A is a pictorial diagram of a conventional telecommunications plug.
Figure 1B:
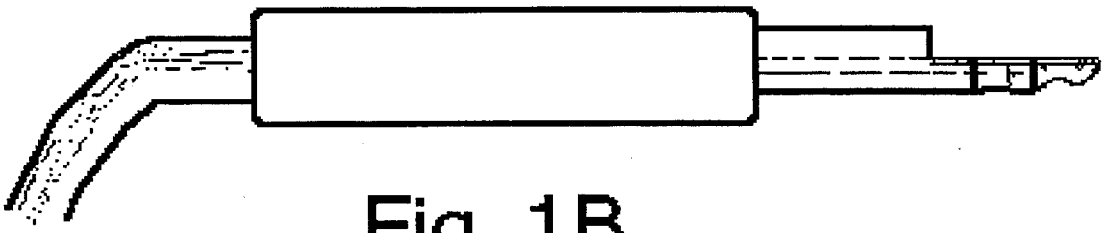
Fig. 1B Prior Art
FIG. 1B is a pictorial diagram of the prior art telecommunications plug of FIG. 1A modified to be semi-circular in shape.
Figure 2:
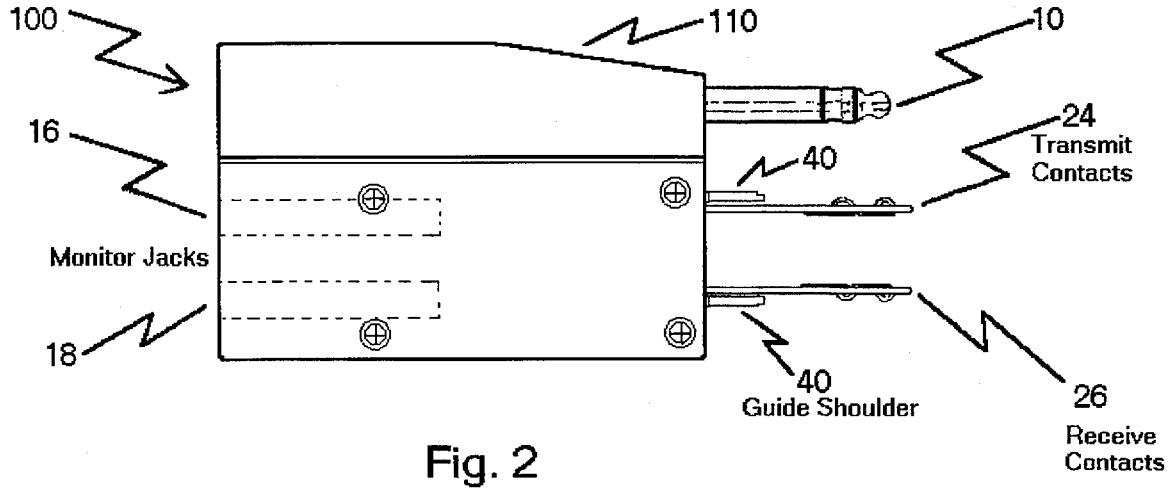
FIG. 2 is a pictorial diagram of a monitoring plug module constructed in accordance with a first embodiment of the present invention.
Figure 3:
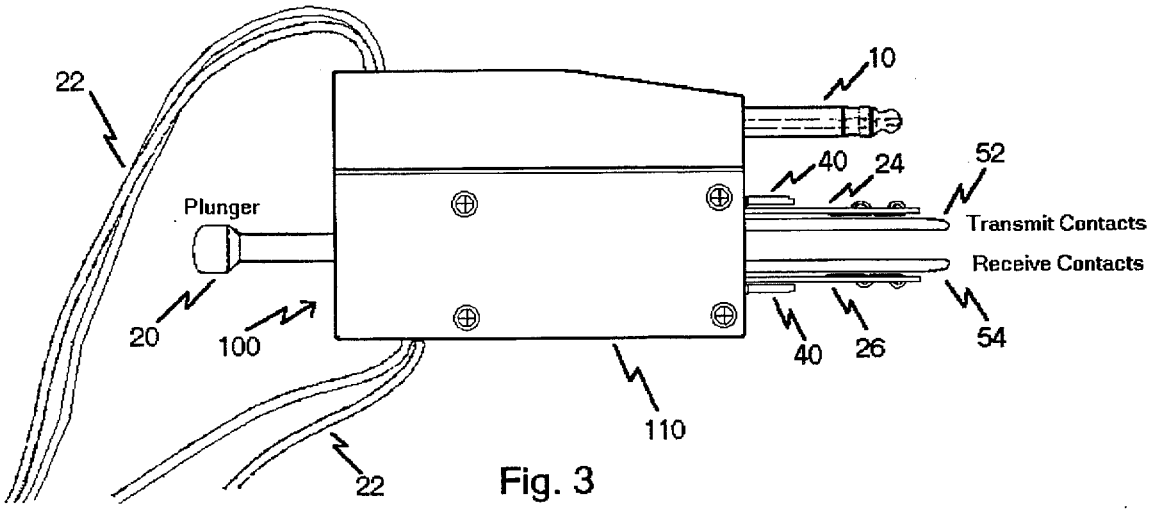
FIG. 3 is a pictorial diagram of a monitoring plug module constructed in accordance with a second embodiment of the present invention.

Referring now to FIGS. 2 and 3, there is shown a DSX telecommunications plug module 100 constructed in accordance with the present invention. Plug module 100 comprises a plastic or other non-conductive housing 110 having a guide plug member 10 and two parallel contact assemblies 24, 26 protruding from the front thereof. Guide plug member 10 is a standard plug member adapted to be inserted into the monitor jack of a conventional mating target jack module. Exemplary of such standard plug members are the "310" plug, the bantam plug, etc. No signals are actually accessed through the electrical connection made by plug member 10. It is employed to simply serve as an alignment mechanism and to securely retain the plug module 100 once it has been plugged into a mating target jack module. Contact assemblies 24, 26 of plug module 100 are positioned below guide plug member 10 for mating insertion into the transmit and receive jack positions of the mating target jack module. Contact assemblies 24, 26 are designed such that when plug module 100 is inserted into the mating target jack module they will make an electrical connection with the internal contacts of the target jack module without moving or disturbing those contacts and causing resultant errors in the customer's traffic. Two industry standard bantam jacks 16, 18 are located on the rear surface of the plug module 100 to accept conventional bantam plugs. These jacks 16, 18 are provided to prevent shorting of the internal tip and ring contacts while plug module 100 is inserted into a mating target jack module. However, four optional internal resistors of approximately 4000 ohms each may be connected in series, with two on the transmit pair and two on the receive pair, to eliminate the possibility of a direct short when inserting a non-standard plug into either of jacks 16, 18. These resistors may be mounted on circuit boards within plug module 100. Inserting a mating plug into either of the jacks 16, 18 will not break the circuit connections of the original circuit as would happen if they were instead inserted directly into the target jack module. By changing the types of jacks 16, 18 inside the plug module 100, an adapter is realized that will permit the use of a different plug to monitor a particular circuit. For example, if the target jack module utilizes a "310" style jack, the "310" style of the plug module 100 can be inserted into the target jack module. Jacks 16, 18 on the rear of the "310" style plug module 100 may be either "310" style jacks or bantam style jacks. If the jacks 16, 18 on the rear of the plug module 100 are bantam style jacks, then the mating bantam plug is inserted to monitor the circuit. A bantam plug cannot plug directly into a "310" style jack. However, using the plug module 100 of the present invention in this fashion provides the functions of an adapter.

Figure 9A:
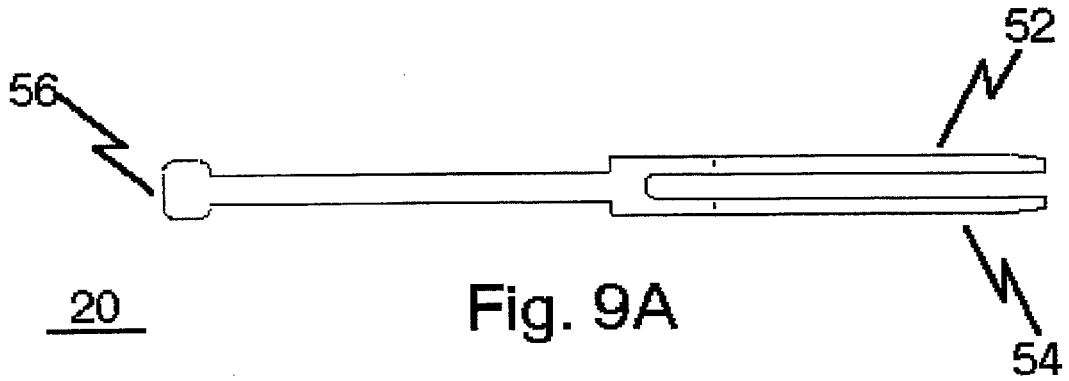
FIGS. 9A–B are detailed top and front pictorial diagrams of the plunger employed in the plug module of FIG. 3.
Figure 9B:
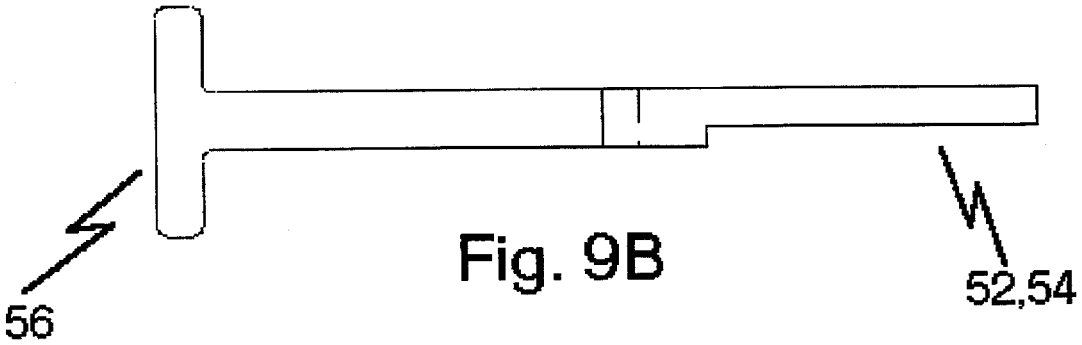
Figure 10:
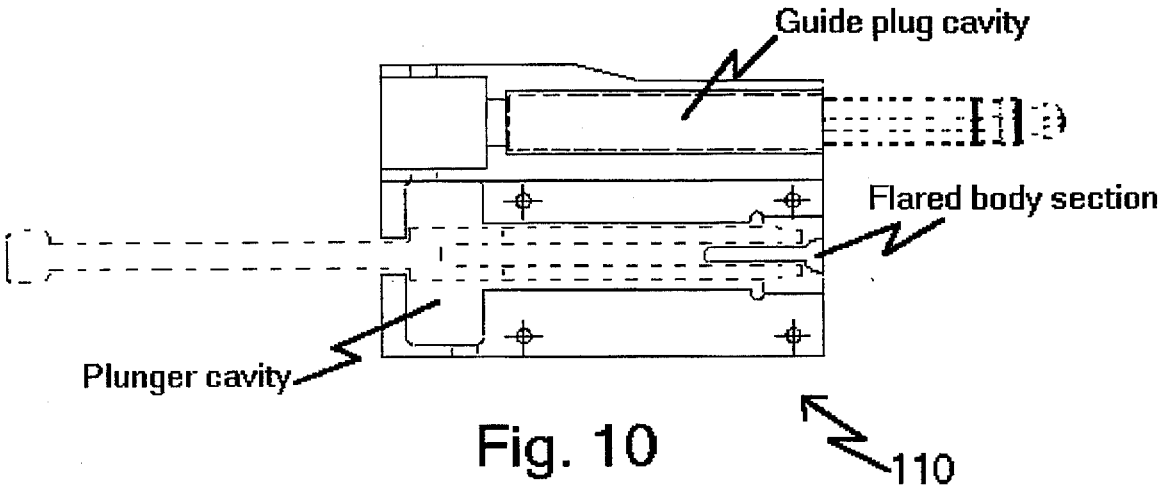
FIG. 10 is a pictorial diagram illustrating the plunger cavity within the housing of the plug module of FIG. 3.

Referring now to FIG. 3, there is shown the telecommunications plug module 100 of FIG. 2, with the addition of a plunger 20 that is described in detail herinafter in association with FIGS. 9A–B and 10. Plunger 20 is optionally provided on plug module 100 to enable the user to break the connections of the original circuit path. This is done by pushing plunger 20 inward, whereas withdrawing it will restore the circuit connections. This feature is useful in situations in which it is necessary to rewire the original circuit path or to change the transmission equipment without fear of shorting the circuit while doing so. By using plug module 100 to monitor the original circuit, a secondary transmission path can be set up that carries a copy of the customer's data in parallel with the original circuit path. Once this secondary circuit path is working properly, the plunger 20 can be pushed inward to isolate the original circuit path from the secondary circuit path. The original circuit path may then be rewired, changed or eliminated, as desired, without detrimental effects on the customer's traffic. Once the circuit path changes have been accomplished, the plunger 20 is simply withdrawn to re-establish the internal jack connections.

If desired, jacks 16, 18 on the rear of plug module 100 of FIG. 2 may be eliminated and replaced with cables 22, as illustrated in FIG. 3, that may be terminated in any chosen type of connector. This configuration permits monitoring of the circuit signals by any type of equipment by simply changing the connector in which cables 22 are terminated. This configuration of plug module 100 may be provided with or without the internal protection resistors discussed above. If provided without these resistors, care must be taken to avoid shorting the cables 22 when connecting them to external monitoring equipment.

Figure 4:
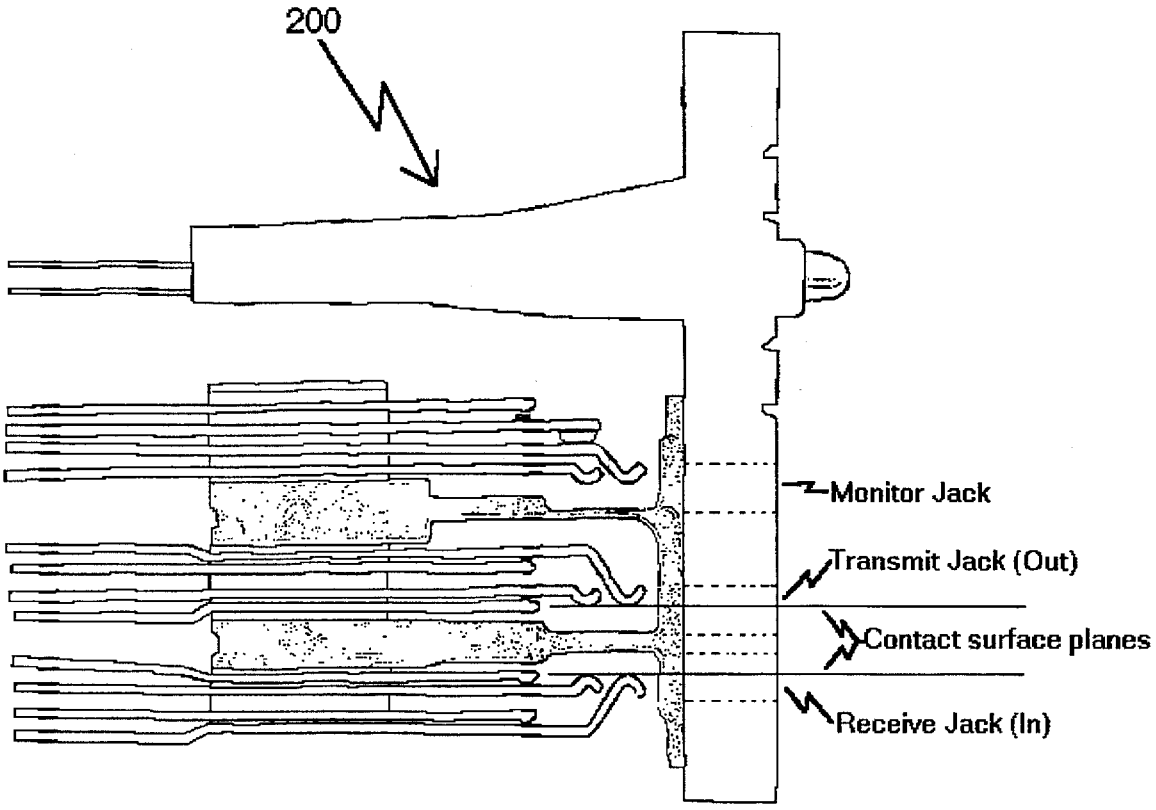
FIG. 4 is a detailed pictorial diagram of a conventional telecommunications jack module into which the plug modules of FIGS. 2 and 3 are adapted to be inserted.
Figure 5A:
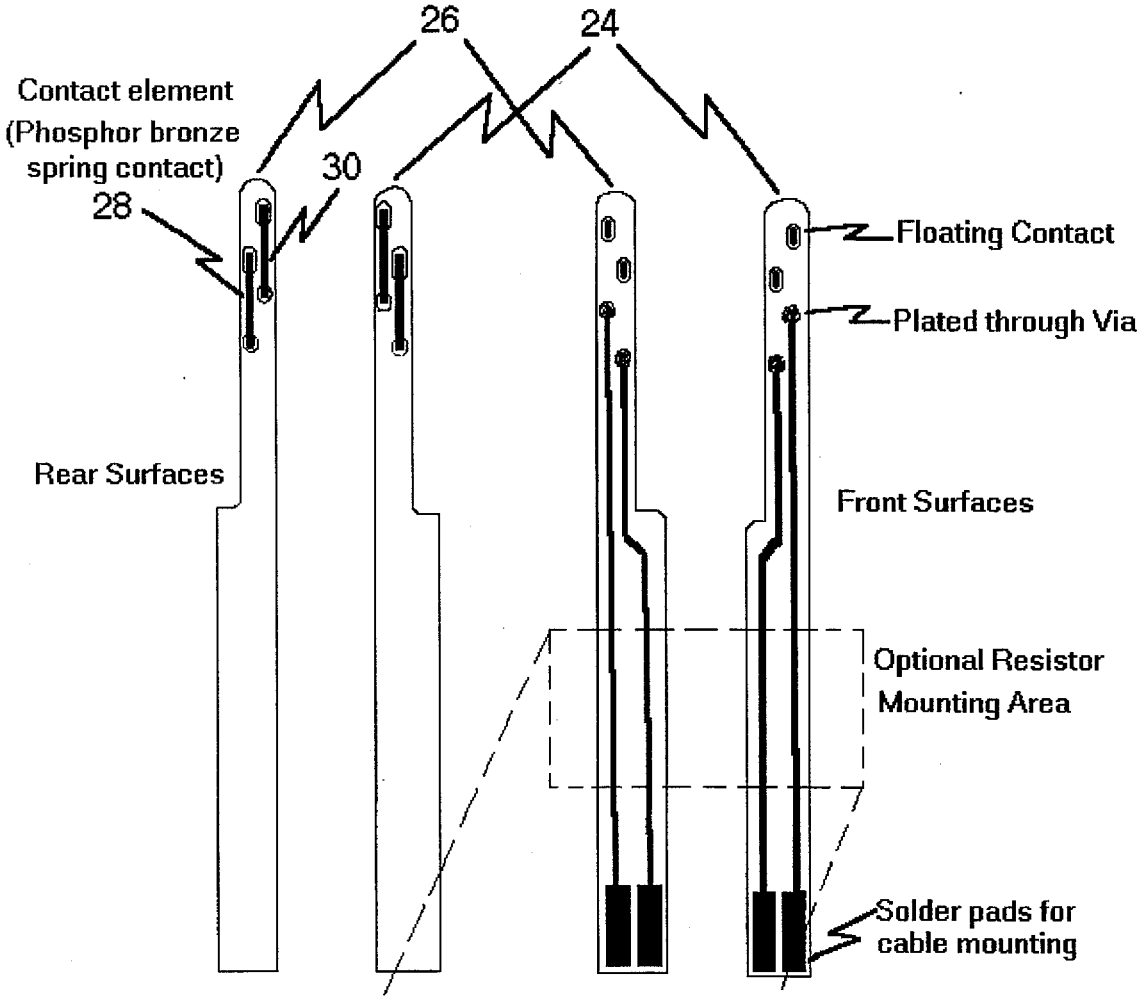
FIG. 5A is a pictorial diagram of the two contact assemblies employed in the plug modules of FIGS. 2 and 3.
Figure 5B:
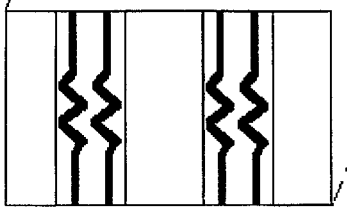
FIG. 5B is an exploded diagram of the optional resistor mounting area illustrated in FIG. 5A.
Figure 6:
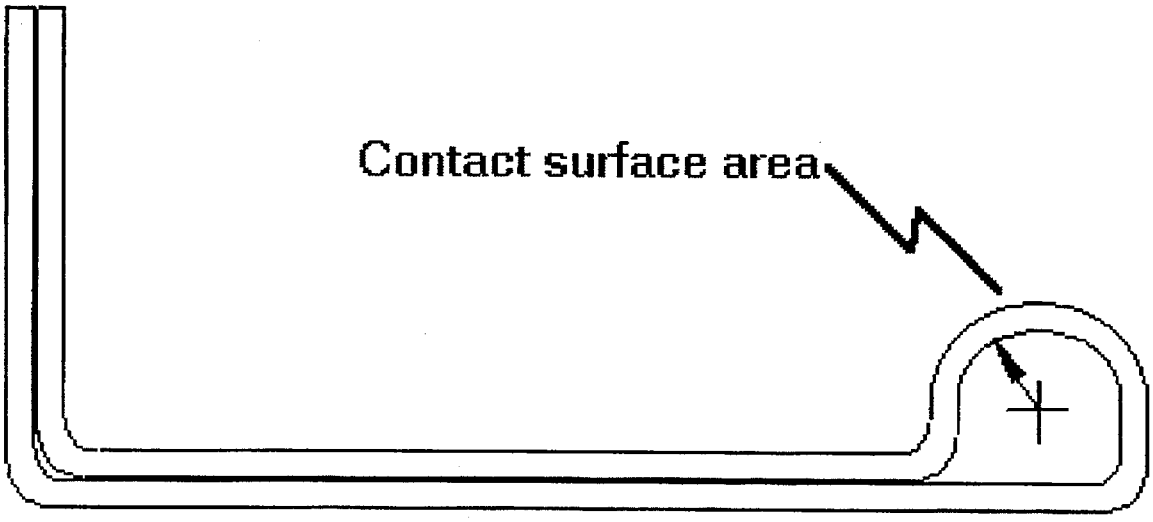
FIG. 6 is a pictorial diagram of one of the contact elements employed in the contact assemblies of FIGS. 5A–B.
Figure 7:
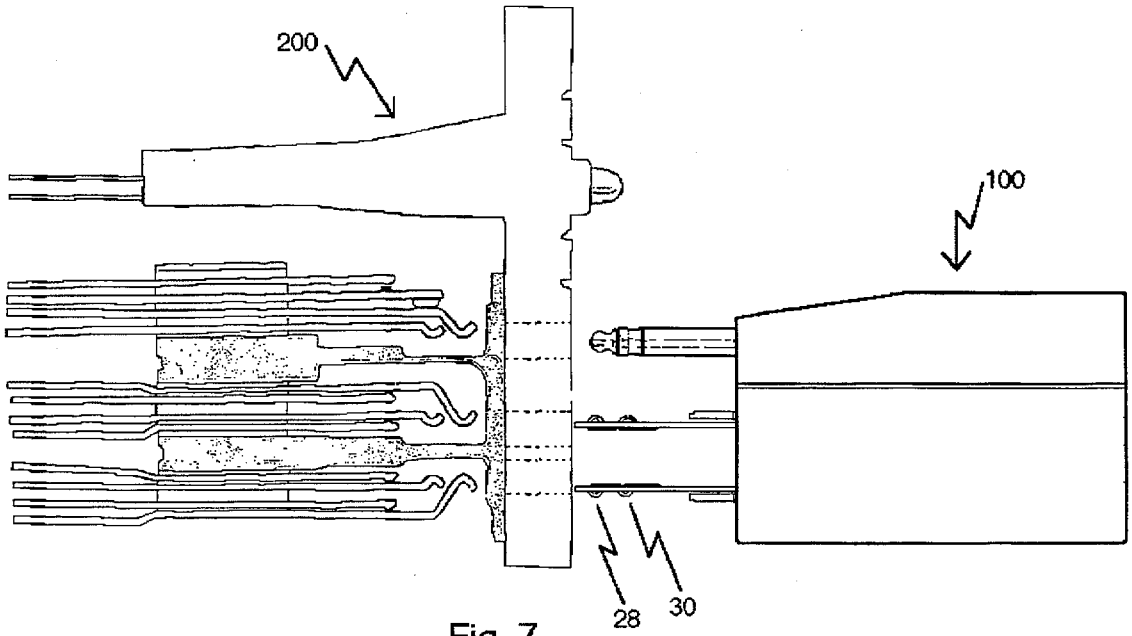
FIG. 7 is a detailed pictorial diagram illustrating the positions of one of the plug modules of FIGS. 2 and 3 prior to insertion into the jack module of FIG. 4.

Referring now to FIG. 4, there is shown a pictorial cross section of a conventional target jack module 200, including internal contacts, into which the plug module 100 of the present invention is inserted during use. Referring also to FIG. 5, there are shown two contact assemblies 24, 26 that are arranged to mate with the transmit and receive jacks of the target jack module 200 of FIG. 4. The two contact assemblies 24, 26 of FIG. 4 are identical except that they are mirror images of each other. They are installed back to back inside the plug module 100. Contact assemblies 24, 26 preferably comprise standard FR4 type printed circuit board material with copper traces, two phosphor bronze contact elements, and two optional 4000-ohm protective resistors. A typical contact element is illustrated in FIG. 6 and is attached to the circuit board material by inserting a straight end through a copper via in the printed circuit board, soldering it in place in the via, and then cutting it flush with the top of the printed circuit board. Electrical connection to the internal contacts of the jack module 200 are made through the contact elements 28, 30 on each of the two contact assemblies 24, 26. Jacks or cable conductors may be connected, as desired, to the ends of the two contact assemblies 24, 26 opposite the contact elements 28, 30. The contact elements 28, 30 are preferably fabricated from conventional 0.0080 thick phosphor bronze contact spring material. The soldered end is held securely to the printed circuit board, while the other end, having a 0.0280 radius loop, is allowed to float free. This floating end forms the actual contact surface that makes electrical connection to the internal contacts of jack module 200. The outer surfaces of the contact assemblies 24, 26 are positioned so that they lie in the same plane as the corresponding contact surfaces internal to the jack module 200, when the plug module 100 is inserted into jack module 200, as illustrated in FIG. 7. When the plug module 100 is inserted into the jack module 200, the rounded surfaces of the contact elements 28, 30 first come into contact with the front edge of the longest contact within the jack module 200. Those contact elements will be deflected downward by the contact within the jack module 200, since it is much stronger than the contact elements 28, 30 of the plug module 100. This downward force causes the contact elements 28, 30 to flex away from the back surface of the printed circuit board to which they are soldered. The force required to flex the contact elements 28, 30 is far less than that required to separate the internal contacts of the jack module 200, yet sufficient to maintain positive contact as insertion of the plug module 100 into the jack module 200 is initiated. As the plug module 100 is inserted further, the first contact element 28 continues to slide past the first internal contact of jack module 200 and flexes back to its original position after it passes that first internal contact. The diameter of the mating surface of the contact elements 28, 30 is sufficiently small to prevent shorting of the two internal contacts of jack module 200 while plug module 100 is being inserted or withdrawn therefrom. The diameter of the contact elements 28, 30 is nevertheless sufficiently large to ensure that the force generated by its flexing under the internal contact of jack module 200 will provide a good electical connection. The printed circuit board material is used to fabricate the contact assemblies 24, 26 so that the contact elements 28, 30 will not themslves be bent or flex upward toward the internal contacts of jack module 200 and cause an inadvertent short in the circuit paths. This force is also necessary to create an effective wiping action to clean the internal contacts of jack module 200 and keep them free of dirt, grime or oxidation which may otherwise build up over time.

Figure 8:
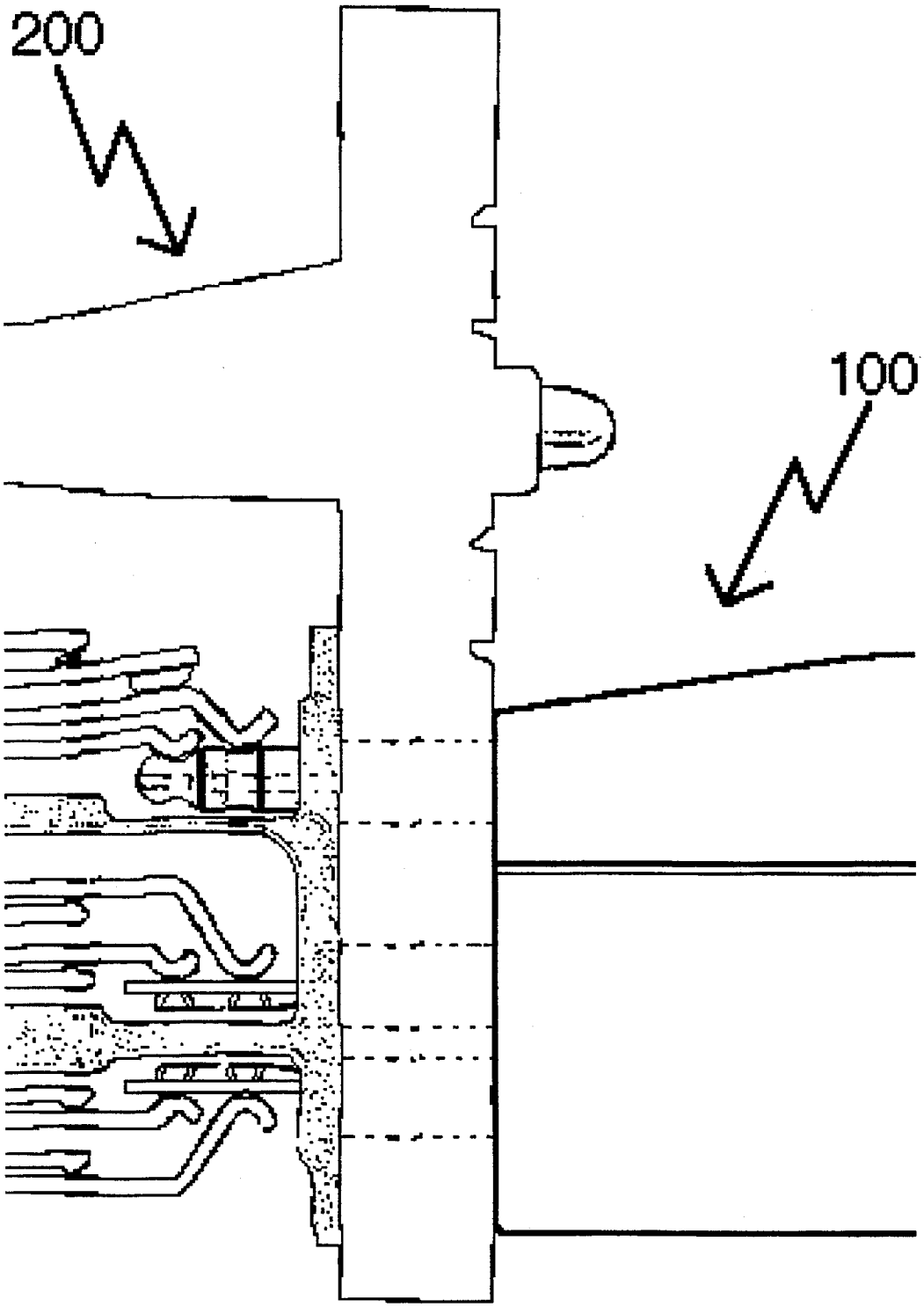
FIG. 8 is a detailed pictorial diagram illustrating one of the plug modules of FIGS. 2 and 3 when fully inserted into the jack module of FIGS. 4 and 7.

Once the plug module 100 is fully inserted into jack module 200, as illustrated in FIG. 8, the two contact elements 28, 30 of each of the contact assemblies 24, 26 are centered on the mating internal contact surfaces of jack module 200. The contact assemblies 24, 26 are not rigidly fixed within the plug module 100. Sufficient movement is permitted to allow the contact assemblies 24, 26 to self align to the mating plane of the internal contacts of jack module 200. This provides greater reliability for proper mating to jack modules in which the two internal contacts are not properly aligned or do not lie in the same plane. It also allows for mating to jack modules made by different manufacturers, since the mating plane separation tends to vary from manufacturer to manufacturer and from model to model.

Referring again to FIG. 2, there are shown two guide shoulders 40 that extend from the housing 110 of plug assembly 100 adjacent the outer sides of the contact assemblies 24, 26. Guide shoulders 40 are preferably molded as part of the housing 110 and serve to position the plug module 100 as it is being inserted into jack module 200.

Referring now to FIGS. 9A–B and 10, there are shown the details of the plunger 20 of FIG. 3. As stated above, plunger 20 serves to break the existing electrical connection when a new circuit path has been established by separating the internal contacts of the jack module 200. As illustrated in detail in FIGS. 9A–B, plunger 20 resembles a tuning fork. When monitoring a particular circuit path, the handle end 56 of plunger 20 is pulled away from plug module 100 until the fork ends 52, 54 of plunger 20 are drawn completely inside the housing 110 of plug module 100. With the plunger 20 in this position, the plug module 100 is inserted into the target jack module 200. It is not possible to insert the plug module 100 into the jack module 200 unless the plunger 20 is completely withdrawn. The plunger 20 remains in this position so long as it is desired to monitor a particular circuit path. However, at such time as it is desired to break the circuit path being monitored, the plunger 20 is pushed forward toward the plug module 100. As the plunger 20 is moved forward, the forks 52, 54 contact a flared section of plastic material formed within the housing 110 of plug module 100, which in turn forces the forks 52, 54 to flare outward. The outward flaring of forks 52, 54 of plunger 20 urges them against the inside surfaces of the printed circuit boards of the contact assemblies 24, 26, which results in urging the printed circuit board material against the mating surfaces of the internal contacts of jack module 200. Once the printed circuit board material is touching the surface of the internal contacts of the jack module 200, the contact assemblies 24, 26, will be fully flexed, and will maintain contact with the internal contacts of the jack module 200. At this point, the outward force generated by the plunger 20 against the inside surface of the contact assembly printed circuit board is transferred to the internal contacts of the jack module 200 via the printed circuit board. The printed circuit board material will tend to flex as it is pushed outwardly by the plunger 20, while the end is held in place by the strong internal contacts of the jack module 200. As the plunger forks 52, 54 move closer to the internal contacts of the jack module 200, the printed circuit board material is unable to maintain its flex, and the ends of the contact assemblies 24, 26 are forced outwardly, thereby separating the internal contacts of the jack module 200.

When the plunger 20 is fully depressed, the forks 52, 54 extend past the ends of the contact assemblies 24, 26 by about ⅛ inch. In this position, the plunger forks 52, 54 are urged against the contact elements 28, 30 directly, and the printed circuit board is no longer carrying any of the load. All of the forces separating the internal contacts of the jack module 200 are transferred through the contact elements 28, 30 to the plunger 20 and to the housing 110 of the plug module 100.

Figure 11:
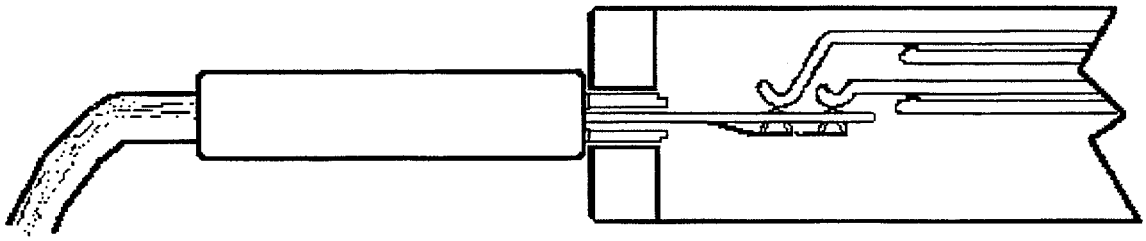
FIG. 11 is a pictorial diagram of a conventional phono jack into which a mating monitoring plug constructed in accordance with the teachings of the present invention is inserted.

While the present invention has been described as a plug for a conventional telecommunications DSX jack, the teachings of the foregoing specification and drawings can be applied to any type of plug such as a standard phone plug. In such other applications, the plug requires only one contact for monaural applications and two contacts for stereo applications, as illustrated in FIG. 11 of the drawings.

We claim:

1. A monitor phone plug for mating with a conventional phone jack for making electrical connection to a circuit routed through the phone jack without thereby breaking the circuit, the monitor phone plug comprising:

a body portion for being held by the user when inserting the monitor phone plug into and removing it from the phone jack; and a contact assembly extending longitudinally forward of the body portion and comprising a generally flat plug member having at least one electrical contact for making electrical connection to a contact within the conventional phone jack without interrupting an internal electrical connection established by the contact within the conventional phone jack.

2. A monitor plug for mating with a conventional DSX telecommunications jack module of the type that includes an upper monitor jack, a transmit jack below the monitor jack, and a receive jack below the transmit jack, the monitor plug comprising:

a body portion for being held by the user when inserting the monitor plug into and removing it from the DSX telecommunications jack module;

a receive contact assembly extending longitudinally forward of the body portion and comprising a generally flat plug member having a plurality of electrical contacts for making electrical connection to a plurality of receive contacts within the DSX telecommunications jack module without interrupting an internal receive electrical connection established by the plurality of receive contacts within the DSX telecommunications jack module;

a transmit contact assembly extending longitudinally forward of the body portion and parallel to the receive contact assembly, the transmit contact assembly comprising a generally flat plug member having a plurality of electrical contacts for making electrical connection to a plurality of transmit contacts within the DSX telecommunications jack module without interrupting an internal transmit electrical connection established by the plurality of transmit contacts within the DSX telecommunications jack module; and means within said body portion for electrically connecting the transmit and receive contact assemblies to an external device.

3. A monitor plug as in claim 2 wherein the means for electrically connecting the transmit and receive contact assemblies to an external device comprises a pair of jacks positioned within the body portion and electrically connected to the transmit and receive contact assemblies, the pair of jacks adapted to receive mating plugs inserted into a rear end of said body portion.

4. A monitor plug as in claim 2 wherein the means for electrically connecting the transmit and receive contact assemblies to an external device comprises a cable, one end of which is positioned within the body portion and electrically connected to the transmit and receive contact assemblies and the other end of which extends outside the body portion for direct connection to the external device.

5. A monitor plug as in claim 2, further comprising means for breaking the internal receive and transmit electrical connections made respectively by the receive and transmit contacts within the DSX telecommunications jack module after the monitor plug is inserted into the DSX telecommunications jack module.

6. A monitor plug as in claim 5, wherein the means for breaking the internal receive and transmit electrical connections comprises a plunger member actuable by the user, the plunger member being mounted within the body portion and having a pair of forked ends that are extended into the DSX telecommunications plug upon actuation of the plunger member following insertion of the monitor plug into the DSX telecommunications jack module for physically separating the receive and transmit contacts within the DSX telecommunications jack module.

7. A monitor plug as in claim 2, further comprising a plurality of protection resistors mounted within the body portion and electrically connected in series with contact elements of said receive and transmit contact assemblies to prevent inadvertent shorting of the receive and transmit contacts within the DSX telecommunications jack module when electrical connection is made to the external device.

* * * * *